US005147226A

United States Patent [19]

Kile

[11] Patent Number: 5,147,226

[45] Date of Patent: * Sep. 15, 1992

[54] CONNECTOR ASSEMBLY AND KEYED ALIGNMENT ASSIST SHROUD THEREFOR

[75] Inventor: Richard A. Kile, Hummelstown, Pa.

[73] Assignee: AMP Incorporated, Harrisburg, Pa.

[ * ] Notice: The portion of the term of this patent subsequent to Aug. 6, 2008 has been disclaimed.

[21] Appl. No.: 645,863

[22] Filed: Jan. 25, 1991

[51] Int. Cl.[5] ..... H01R 13/64

[52] U.S. Cl. ..... 439/680; 439/374; 439/564

[58] Field of Search ..... 439/60-62, 439/64-66, 76, 79, 569-572, 629-637, 680, 681

[56] References Cited

U.S. PATENT DOCUMENTS

| | | | |
|---|---|---|---|
| 3,264,599 | 8/1966 | Kinkaid | 339/17 |
| 3,325,771 | 6/1967 | Ruehlemann et al. | 439/681 |
| 3,601,770 | 8/1971 | Bowley | 439/629 |
| 3,685,001 | 8/1972 | Krafthefer | 339/17 L |
| 3,768,066 | 10/1973 | Mattingly, Jr. et al. | 339/65 |
| 3,966,290 | 6/1976 | Little et al. | 339/17 LC |
| 4,204,737 | 5/1980 | Faber et al. | 339/65 |
| 4,350,409 | 9/1982 | Kato et al. | 339/186 M |
| 4,507,861 | 4/1985 | Sprenkle | 29/741 |
| 4,530,561 | 7/1985 | Tyree et al. | 439/570 |
| 4,586,254 | 5/1986 | Ammon et al. | 439/636 |
| 4,596,436 | 6/1986 | Kraemer et al. | 439/680 |
| 4,603,929 | 8/1986 | Fitzpatrick | 339/17 C |
| 4,664,462 | 5/1987 | Owens | 439/564 |
| 4,744,140 | 5/1988 | Bright | 29/741 |
| 4,764,129 | 8/1988 | Jones et al. | 439/680 |
| 4,929,183 | 5/1990 | Rinneburger | 439/67 |
| 5,037,323 | 8/1991 | Locati | 439/374 |

FOREIGN PATENT DOCUMENTS

| | | | |
|---|---|---|---|
| 0210686 | 2/1987 | European Pat. Off. | 439/570 |
| 6503360 | 9/1965 | Netherlands | 439/570 |

OTHER PUBLICATIONS

IBM Technical Disclosure Bulletin, vol. 33, No. 1A, Jun. 1990.

*Primary Examiner*—Larry I. Schwartz
*Assistant Examiner*—Hien D. Vu
*Attorney, Agent, or Firm*—David L. Smith

[57] ABSTRACT

An alignment and blind mate assist shroud (22) for positioning on a first end (34) of a connector housing (24) has a body section securable to the first end of the connector housing (24). The shroud has a key (75) receivable in a keyway (35) proximate the first end of the connector housing and a keying protrusion (150) adapted to extend beyond the mounting face (48,50) of the connector housing (24) to key the connector assembly (62) to a particular one of several possible assembly receiving locations on the circuit board (154) on which the assembly (62) is mounted. The polarization protrusion (150) cooperates with an aperture (152) in the circuit board (154) on which the connector assembly (62) is adapted to be mounted to assure that the appropriate connector assembly (62) is mounted at the corresponding location on the circuit board. An alignment and blind mate assist shroud (23) without a key or keying protrusion may be secured to the second end (34) of the connector housing (24).

16 Claims, 2 Drawing Sheets

CONNECTOR ASSEMBLY AND KEYED ALIGNMENT ASSIST SHROUD THEREFOR

BACKGROUND OF THE INVENTION

This invention relates to electrical connectors and, in particular, to a shroud for securing to an electrical connector to key the assembly to one of several locations on a printed circuit board. The shroud has a keying feature complementary to keying structure on the connector to assure it is securable to only one end of the connector and a protrusion receivable in an aperture in the circuit board on which the connector is mounted to assure that the appropriate connector is positioned at the corresponding appropriate one of several possible locations for such connectors on the circuit board.

Alignment and blind mate assist shrouds securable to a connector to form a connector assembly mountable to a circuit board are known. One application has required that several such connector assemblies be mounted to a single circuit board. In an effort to assist those persons who assemble the mating or complementary connectors to the various connector assemblies on a single board to correlate a particular mating connector to the intended one of the several possible connector assemblies, the pair of shrouds secured to each connector on the board have been made of various colors of plastic such as yellow, red, white, gray, green, or blue. That is, each connector had secured to it two shrouds of a single particular color so as to color code each connector assembly by the color of the shrouds. While this approach was successful to help those who assembled the mating connectors to the various connector assemblies by permitting the mating connector assembler to select the proper one of the assemblies to mate a particular mating connector to by color, it was successful only if the connector assembly having the appropriate color shrouds was positioned at the corresponding location on the circuit board during stuffing of the components thereon. Since each of the prior art shrouds was identical to the other shrouds, but for color, there was always the possibility that an error could be made in positioning a connector assembly having shrouds of the wrong color at a particular assembly receiving position on a circuit board. This could then lead to the wrong mating connector being mated thereto. When placing a polarization feature on the shroud and providing multiple locations for the polarization feature, there resulted a need to be assured when the shroud with the polarization and keying function was placed on the connector, it was received on the appropriate end.

There is disclosed in U.S. Pat. No. 4,507,861 a tool for grasping then stuffing rectangular electronic components on a circuit board. The tool has foot-like extensions for grasping the electronic component at each of the corners. Three of the four foot-like extensions have locator pins receivable in apertures in the printed circuit board to provide a polarization feature to assure that the tool stuffs the component on the circuit board with a particular orientation.

U.S. Pat. No. 4,744,140 discloses a tool for mounting connectors onto a circuit board. The tool includes a pair of pins, one of smaller diameter and one of larger diameter, which pass through holes in the connector to be mounted then into corresponding apertures in the printed circuit board. The tool provides for the connector to be received on the pins in only one orientation and, since the board is provided with holes identically sized to the pins and precisely located, the connector is positioned on the board by the tool in a predetermined orientation that accurately pilots the connector leads into plated through holes in the circuit board.

SUMMARY OF THE INVENTION

In accordance with the present invention, an alignment and blind mate assist shroud for positioning on a first end of a connector housing has a body section securable to the first end of the connector housing. The shroud has a shroud-to-connector housing key receivable in a keyway proximate the first end of the connector housing and a connector assembly-to-circuit board keying protrusion adapted to extend beyond the mounting face of the connector housing to be received in an aperture in the circuit board on which the connector and shroud assembly is adapted to be mounted to key the connector and shroud assembly to a particular one of several possible locations on a circuit board. An alignment and blind mate assist shroud without keying to the connector housing and without a keying protrusion may be secured to the second end of the connector housing.

DESCRIPTION OF THE PREFERRED EMBODIMENT

Figure 1:
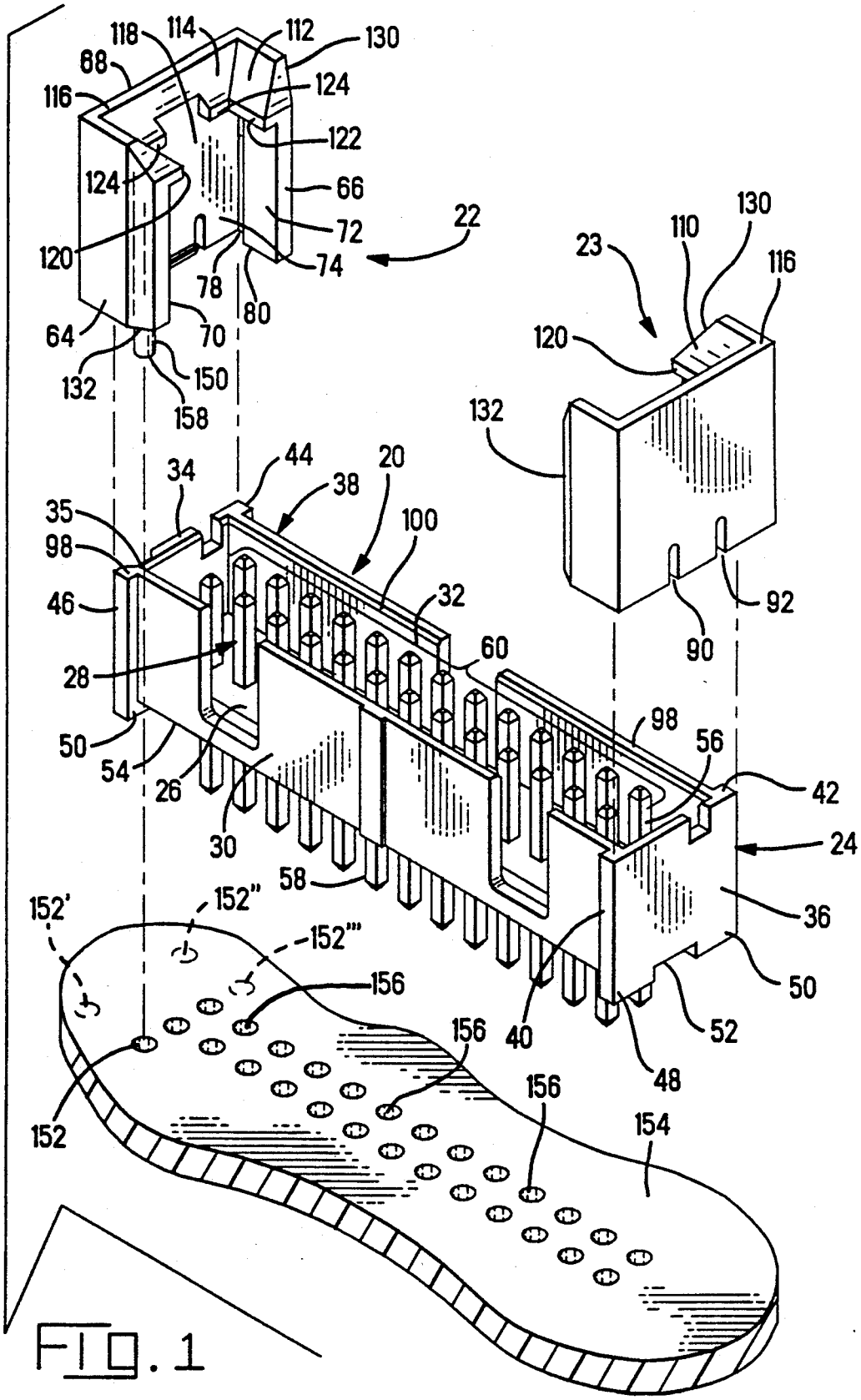
FIG. 1 is a perspective view of a pin header having an alignment and blind mate assist shroud, in accordance with the present invention, and another alignment and blind mate assist shroud exploded therefrom and exploded from a portion of a circuit board.
Figure 2:
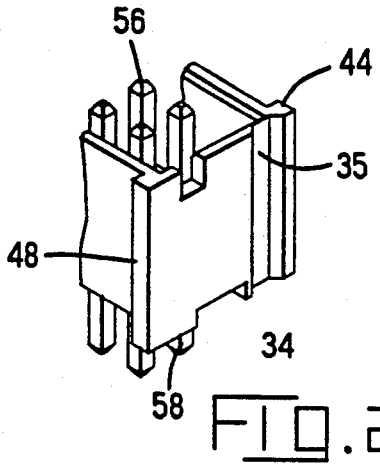
FIG. 2 is a perspective view of the first end of the pin header showing a keyway.

FIG. 1 illustrates a pin header 20 having two alignment and blind mate assist shrouds 22,23 in accordance with the present invention positioned thereabove exploded from a portion of a circuit board 154. Circuit board 154 has a protrusion receiving aperture 152 positioned for reception of protrusion 150 as header 20 is mounted on board 154 and solder tail portions 58 are received in plated through holes 156. Pin header 20 includes a housing 24 molded of a suitable plastic having base 26 through which pins 28 extend. Housing 24 is elongate and includes sidewalls 30 and 32 integral with and extending transverse to base 26, and first and second end walls 34 and 36 also integral with and extending transverse to base 26. Walls 30, 32, 34 and 36 surround pins 28 to define shroud 38. Endwalls 34 and 36 extend outwardly beyond sidewalls 30 and 32 to form substantially identical ribs 40, 42, 44 and 46. Endwalls 34 and 36 extend downward from base 26 to form stand-offs 48 and 50 with recesses 52, substantially coplanar with bottom surface 54 of base 26, therebetween. First endwall 34 has a vertical channel or slot keyway 35 recessed therein. Keyway 35 extends from the top of shroud 38 toward the bottom of endwall 34. In a preferred embodiment keyway 35 is closer to one of sidewalls 30 or 32 than the other, keyway 35 extends to the bottom of endwall 34 and keyway 35 is trapezoidal in cross section Pins 28 may be any known structure and are typically spaced on 0.100 inch (2.54 mm) center lines both between adjacent pins in a row and between rows of pins. Pins 28 have a mating portion 56 extending upwardly from base 26 substantially the height of shroud 38 and a solder tail portion 58 extending below base 26 for reception in plated through holes in circuit board 154. Pins 28 are secured in base 26 and form an array 60.

Alignment and blind mate assist shrouds 22,23 shown exploded from respective endwalls 34 and 36 in FIG. 1, as well as secured to pin header 20 in FIG. 4 forming assembly 62, are very similar and therefor only one will be described in great detail with the differences then set forth. Shrouds 22 and 23 are molded of a suitable plastic.

Figure 3:
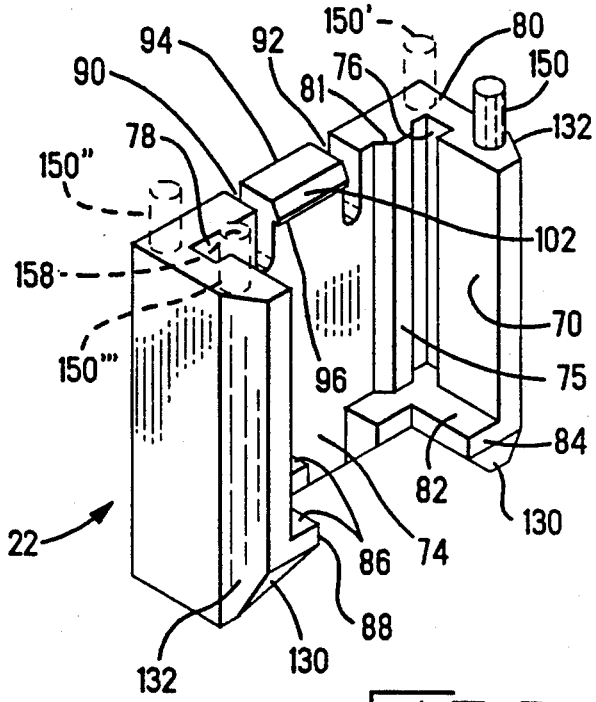
FIG. 3 is a bottom perspective view of an alignment and blind mate assist shroud having a key receivable in the keyway of the first end of the pin header and a polarization protrusion, further showing in phantom other possible locations of polarization protrusions.
Figure 4:
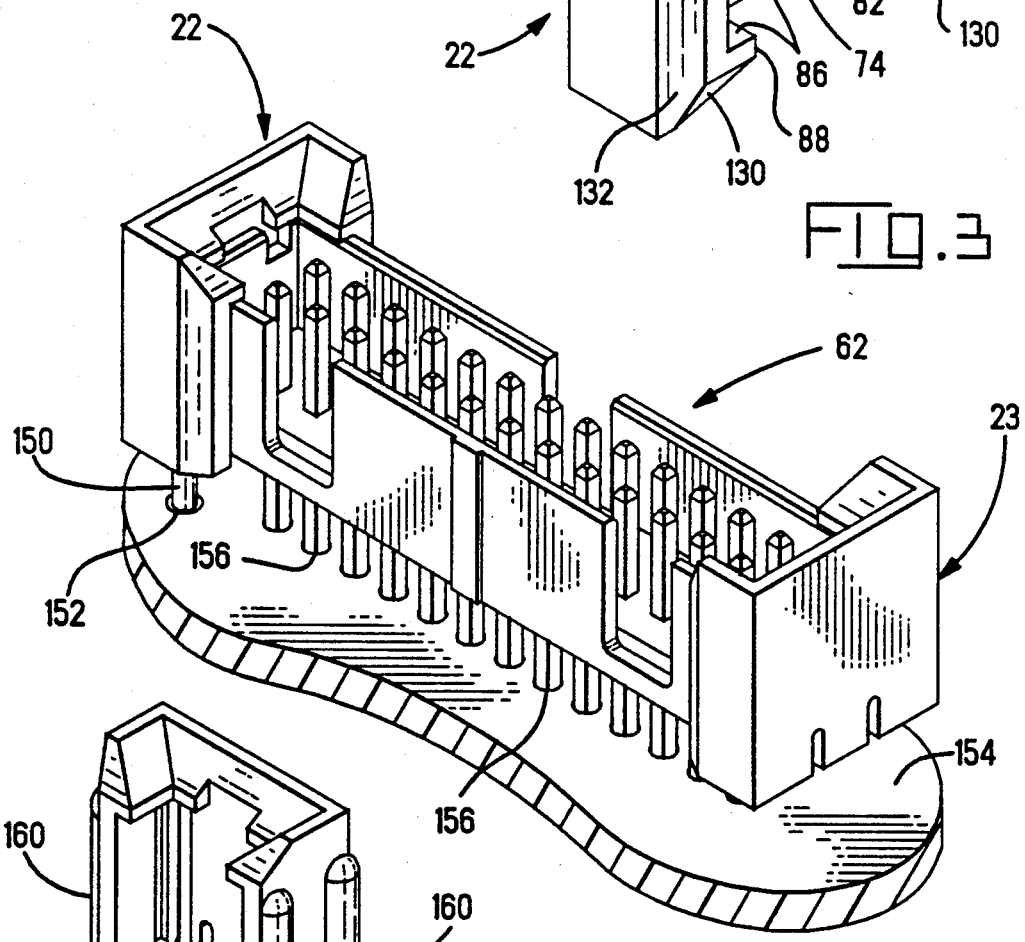
FIG. 4 is a perspective view of a pin header assembly in accordance with the present invention, including two alignment and blind mate assist shrouds, being mounted to the portion of the printed circuit board shown in FIG. 1.

As best seen in FIGS. 1, 3 and 4, shroud 22 is substantially U-shaped in cross section having side members 64 and 66 interconnected by end member 68. Shroud 22 consists of a body portion securable to an endwall of pin header 20 and an extension portion adapted to extend above shroud 38 to assist in aligning a complementary connector during mating or unmating thereof. Shroud 22 has a protrusion 150 extending therefrom typically in the opposite direction from the extension portion. Inner surfaces 70 and 72 of side members 64 and 66 respectively are spaced substantially as the outer surface of sidewalls 30 and 32. Extending into side members 64 and 66 beyond surfaces 70 and 72 adjacent to inner surface 74 of end member 68 are channels 76 and 78. Channel 76 is complementary to ribs 46 or 42 and extends from bottom surface 80 to the lower surface 82 of offset 84 (see FIG. 3). Similarly channel 78 is complementary to ribs 40 or 44 and extends from bottom surface 80 to the lower surface 86 of offset 88.

Key 75 extends outwardly transverse to inner surface 74. Key 75 is positioned to be received in keyway 35 when shroud 22 is slid onto pin header 20 and has a shape receivable therein. In a preferred embodiment, key 75 is a rib that extends along inner surface 74 from bottom surface 80 to lower surface 82 and has a trapezoidal cross section. That portion of key 75 coplanar with and forming a portion of bottom surface 80 is end surface 81.

In this manner, shroud 22 is keyed to be received only on one endwall of shroud 38, endwall 34 thereby assuring the shroud with the polarization and keying feature is received on the appropriate end of header 20. Any attempt to position shroud 22 on endwall 36 would cause end surface 81 of key 75 to engage the top surface 98 of endwall 36 thereby preventing shroud 22 from being received on or securable to endwall 36.

A shroud 22 without key 75 thereon can be received on either of endwalls 34 or 36. A keyed shroud such as shroud 23 having key 75 can only be received on endwall 34 having keyway 35 to receive and accommodate key 75. In this manner, pin header 20 is versatile in that it can be sold without alignment shrouds 22 or 23, with an alignment shroud 23 secured on each of endwalls 34 and 36, or with an alignment shroud 22 secured on endwall 34 and an alignment shroud 23 secured on endwall 36.

Shroud 22 has a protrusion 150 extending beyond bottom surface 80 from a predetermined location thereon to extend beyond a bottom surface of header 20 when secured thereto. Protrusion 150 serves the dual functions of assembly-to-board polarization and keying. In the preferred embodiment, protrusion 150 is cylindrical in cross section so as to be received in an aperture drilled in the circuit board on which shroud 22 is mounted.

End member 68 has a pair of spaced slots 90, 92 extending upwardly from bottom surface 80 defining therebetween latch 94. Latch 94 assures that shroud 22 is retained on header 20. Latch 94 provides a latch shoulder 96 extending inwardly from inner surface 74 and spaced from lower surfaces 82 and 86 substantially the distance from top surface 98 of shroud 38 to recess 52, which is typically the bottom surface 54 of base 26. Top surface 98 may be beveled at the inner edge 100. Ramp surface 102 extends from bottom surface 80 angularly upwardly toward latch shoulder 96 to facilitate positioning.

Protrusion 150 extends from shroud 22 of assembly 62 at a location to be received in aperture 152 of circuit board 154 when solder tail portions 58 are received in plated through holes 156. Protrusion 150 extends to respective distal end 158 sufficiently beyond the end of stand-offs 48,50 to prevent stand-offs 48,50 from engaging printed circuit board 154 if an assembly is positioned at an assembly receiving location on circuit board 154 not intended for that particular assembly 62, that is with a protrusion 150 at one of the other keyed locations.

FIG. 3 shows a protrusion 150 at a particular location on bottom surface 80 and three additional possible locations, shown in phantom as protrusions 150', 150'', and 150'''. In the preferred embodiment only one protrusion is employed on shroud 22, however, the invention is not limited thereto. Each protrusion location 150', 150'' and 150''' on shroud 22 has a corresponding aperture location on board 154 such that the protrusion is received in respective apertures 152', 152'', and 152'''. Four possible protrusion locations are thus defined on bottom surface 80 and four corresponding unique shrouds are defined with only a single protrusion 150, 150', 150'' or 150''' being employed on each shroud 22 in the preferred embodiment.

In this manner, shrouds of a particular color can be manufactured with a protrusion at a particular one of the possible locations to overcome the aforementioned problem and to assure that each assembly is mounted at the corresponding one of several possible assembly receiving locations. When a shroud 22 is received on a header 20 the protrusion 150, 150', 150'' or 150''' provides a housing-to-board polarization feature that polarizes the orientation of assembly 62 relative to board 154 and simultaneously keys assembly 62 to be received at a particular one of several assembly receiving locations on board 154 depending on which one of the possible protrusion locations is employed.

In this manner, the protrusion on shroud 22 of assembly 62 provides a keying function that permits an assembly 62 to be mounted to circuit board 154 with solder tails 58 received in plated through holes 156 and be seated thereagainst when the protrusion also aligns with a respective aperture in the board on which the assembly is to be mounted. With solder tails 58 aligned with or received in plated through holes 156, the protrusion prevents an assembly 62 from mounting to and seating against board 154 when the protrusion does not align with an aperture in board 154. When the protrusion is properly keyed to the location that receives an assembly, in addition to the solder tails being received in plated through holes 156, protrusion 150 is received in aperture 152 as shown in FIG. 4. When the protrusion is located at the position shown by phantom protrusion 150', the board aperture to receive it is shown by phantom aperture 152'. When the protrusion is located at the position shown by phantom protrusion 150'', the board aperture to receive it is shown by phantom aperture 152''. When the protrusion is located at the position shown by phantom protrusion 150''', the board aperture to receive it is shown by phantom aperture 152'''.

Shroud 23 differs from shroud 22 in that shroud 23 does not have key 75 extending from inner surface 74 or protrusion 150 extending from bottom surface 80. In other respects, shroud 23 is identical to shroud 22.

To attach alignment and blind mate assist shrouds 22 and 23 to pin header 20, shrouds 22 and 23 are first positioned above top surface 98 with channels 76 and 78 aligned respectively with ribs 42 and 40 or 46 and 44, sidewalls 30 and 32 aligned between inner surfaces 70 and 72, and inner surface 74 substantially coplanar with the outer surface of a respective endwall 34, 36 as shown in FIG. 1. Shrouds 22,23 and pin header 20 are then moved toward each other. As ribs begin to be received in channels 76, 78, ramp surface 102 engages top surface 98 of shroud 38 at an endwall. The reactionary forces resulting from continued movement of shrouds 22,23 and pin header 20 toward each other causes latch 94 to flex outwardly until the inner edge of ramp surface 102 rides over the endwall. Simultaneously, surface 81 moves past surface 98 and key 75 moves into and along keyway 35 as shroud 22 is moved along endwall 34. As latch 94 slides along endwall 34 or 36, the inner edge 104 slides along a respective endwall 34 or 36. When latch shoulder 96 passes beyond bottom surface 54 in recess 52, latch 94 resiles inwardly to latch beneath bottom surface 54 to secure shrouds 22,23 to pin header 20, resulting in assembly 62 as shown in FIG. 4.

In the preferred embodiment with latch shoulder 96 latched under bottom surface 54 to retain the shroud on header 20, bottom surfaces 80 and 82 engage the top surface 98 of shroud 38. This structure provides means on the shroud cooperable with the header to secure the shroud to the header. Shrouds 22,23 are secured to pin header 20 in a predetermined location with the vertical position of shrouds 22 and 23 maintained relative to pin header 20.

The ribs and channels complement each other to provide means on the shroud cooperable with the header to secure shrouds 22 and 23 to pin header 20. Inner surfaces 70 and 72, sidewalls 30 and 32, ribs 40 and 42 or 44 and 46, channels 76 and 78, endwalls 34 or 36 as well as inner surface 74 cooperate to secure a respective shroud 22,23 on pin header 20 in a predetermined location with the horizontal position of shroud 22 or 23 maintained relative to pin header 20. With shrouds 22 and 23 positioned on and .secured to pin header 20 as described above, resulting in assembly 62 shown in FIG. 4, shrouds 22 and 23 provide an alignment and blind mating function for a complementary receptacle connector, not shown. A typical complementary receptacle connector is part no. 746285-6 sold by the assignee.

Side members 64 and 66 as well as end member 68 extend above top surface 98 of shroud 38 and provide beveled surfaces 110, 112 and 114 respectively which taper inwardly in a direction-from top surface 116 to bottom surface 80. Beveled surfaces 110, 112 and 114 collectively provide lead-in for the complementary connector prior to mating. Recess 118 in beveled surface 114 permits a core pin to be positioned during molding of shrouds 22 and 23 to form latch shoulder 96. Each of beveled surfaces 110, 112 and 114 extend to respective limited height vertical surfaces 120, 122 and 124.

Vertical surface 122 defines the innermost edge of offset 88 which defines the innermost edge of lower surface 86. In the preferred embodiment, vertical surface 122 when shroud 22 or 23 is secured on pin header 20 is substantially coplanar with the inner surface of sidewall 32. In the preferred embodiment this results in offset 88 along side member 66 being substantially the same depth as sidewall 32 is thick. Similarly, vertical surface 122 defines the innermost edge of offset 84 which defines the innermost edge of lower surface 82. Vertical surface 120, when shroud 22 or 23 is secured on pin header 20, is substantially coplanar with the inner surface of sidewall 30. In the preferred embodiment this results in offset 84 along side member 66 being substantially the same depth as sidewall 30 is thick as best seen in FIG. 4. Vertical surface 124 defines the innermost edge of offsets 84 and 88 along inner surface 74. Vertical surface 124, when shrouds 22 and 23 are secured on pin header 20 is substantially coplanar with the inner surface of endwall 36. Thus when a complementary connector is aligned to pass vertical surfaces 120, 122 and 124 it is properly aligned for mating with pins 28 of array 60.

Beveled surfaces 110, 112 and 114 permit a complementary connector to initially be misaligned and guide the complementary connector to a position of alignment. As a complementary connector is moved toward pin header 20 to mate therewith, the complementary connector, if not properly aligned for mating, will engage one or more of the beveled surfaces 110, 112 or 114 on a shroud 22 or 23 or both. As the complementary connector continues to move toward pin header 20 for mating, reactionary forces between the complementary connector and beveled surfaces 110, 112 or 114 will cause the complementary connector to align with the pin header prior to mating. The beveled surfaces extend into vertical surfaces 120, 122 and 124 which further assure alignment prior to mating. The vertical surfaces also maintain alignment of the complementary connector with the pin header during unmating to prevent tilting or peeling of the complementary connector arcuately away from the pin header in a manner that could damage the pins. In this manner, shrouds 22 and 23 obviate the problems of misregistration and misalignment as well as bent pins that were a result of misalignment.

Beveled edges 130 provide a cable guide between edges 130 on the shrouds on opposite ends of pin header 20. Beveled corners 132 taper the thickness of side members 64, 66 to be narrower at distal edges thereof.

Shrouds 22 and 23 provide several advantages. The shrouds are retrofittable and thus can be added after the pin header is placed in service. Placing a shroud only at the ends of a pin header, as opposed to extending the height along the entire length of the pin header, continues to permit a right angle cable exit with the cable passing substantially across the top surface of the shroud. A pin header can be useful in a blind mating environment when shrouds 22 and 23 are utilized. Furthermore, shrouds 22 and 23 can be manufactured of various colors for color coding which one of several otherwise identical pin connectors a particular complementary connector mates with.

Figure 5:
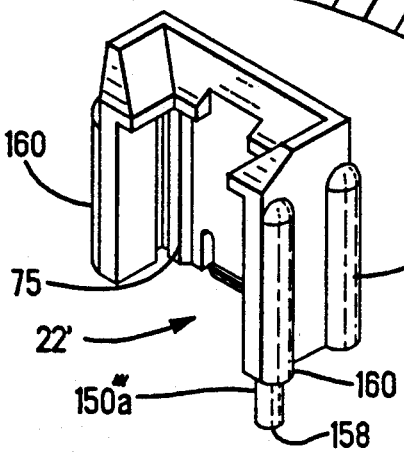
FIG. 5 is a top perspective view of an alternate embodiment alignment and blind mate assist shroud having a key receivable in the keyway of the first end of the pin header and a keying protrusion.

An alternate embodiment blind mate shroud 22' is shown in FIG. 5. Shroud 22' functions in the same manner as shroud 22, with the difference being the diameter of the protrusion 150'''*a*. To accommodate a protrusion having a larger diameter than the wall thickness, a thickened sidewall at least in the regions of columns 160 is provided. Shroud 22' is received over the end of the pin header and secured thereto in the same manner as shroud 22 described above.

While the preferred embodiment of the invention has been disclosed with respect to a through-hole mount connector, the invention may be used with surface mount connectors. In addition, while the preferred embodiment of the invention has been disclosed as utilizing connector assembly 62 having a shroud on a first endwall of pin header 20 that is keyed to the endwall and a shroud on the second endwall that is not keyed to the second endwall, the invention is not limited thereto. The use of shrouds keyed to each endwall of a connector housing is contemplated as within the scope of the invention. While the preferred embodiment has been described with respect to a key extending from inner surface 74 and a complementary keyway 35 recessed in endwall 34, the invention is not limited thereto. The key could be on the endwall with a keyway on the alignment shroud.

I claim:

1. A shroud securable to a connector housing mountable on a circuit board and matable with a complementary connector, the housing having keying structure and a plurality of contacts secured therein, the shroud comprising:

a body section having means cooperable with the connector housing for securing the shroud to the connector housing, said body section having keying means complementary to the keying structure on the connector for cooperating with the keying structure to permit the shroud to be secured to the housing in the presence of keying structure and to prevent the shroud from being secured to the housing in the absence of keying structure, whereby the key structure and the keying means provide a keying system to key the shroud to a connector housing, and an extension section, said extension section adapted to extend beyond the connector housing when the shroud is secured thereto, the extension section having guide means adapted to taper inwardly toward the connector housing for guiding a complementary connector into the connector housing.

2. A shroud as recited in claim 1, wherein the guide means comprise beveled surfaces.

3. A shroud as recited in claim 1, wherein the extension section further comprises an alignment surface between said guide means and the connector housing when the shroud is secured to the connector housing.

4. An electrical connector assembly as recited in claim 1, wherein the extension section further comprises an alignment surface between said guide means and the connector housing.

5. A shroud as recited in claim 1, further comprising a protrusion extending from the body section, said protrusion adapted to extend beyond a bottom surface of the connector housing to be received in an aperture in a circuit board on which the shroud is mounted.

6. A shroud as recited in claim 5, wherein the keying means has a trapezoidal cross section in a plane parallel to the bottom surface of the connector housing.

7. A shroud as recited in claim 1, wherein the keying means comprises an outwardly extending member to be received in the keying structure.

8. A shroud as recited in claim 7, wherein the outwardly extending member comprises a rib on an inner surface of the shroud.

9. An electrical connector assembly mountable on a circuit board and matable with a complementary connector, the assembly comprising:

a connector housing having a plurality of contacts secured therein, the connector housing having at least one wall, said at least one wall having key structure;

at least one shroud member securable to said connector housing, said at least one shroud member having a body section having means cooperable with said connector housing for securing the said at least one shroud member to said connector housing, said at least one shroud member having keying means complementary to said key structure on the connector housing for cooperating with said key structure to permit the said at least one shroud member to be secured to the connector housing when the said at least one shroud member is received on the connector housing and the key structure and keying means coact, and to prevent the said at least one shroud member from being secured to the connector housing in the absence of coaction between the key structure and the keying means, whereby the key structure and the keying means provide a keying system to key a shroud member to a connector housing, said at least one shroud member further having an extension section, said extension section adapted to extend beyond said at least one wall of the connector housing, said extension section having guide means tapered inwardly toward the connector housing for guiding a complementary connector into the connector housing.

10. An electrical connector assembly as recited in claim 9, further comprising a protrusion extending from the body section of said at least one shroud member, said protrusion adapted to extend beyond a bottom surface of the connector housing to be received in an aperture in a circuit board on which the connector assembly is mounted.

11. An electrical connector assembly as recited in claim 9, wherein the keying means has a trapezoidal cross section in a plane parallel to the bottom surface of the connector housing.

12. An electrical connector assembly mountable on a circuit board and matable with a complementary connector, the assembly comprising:

a connector housing having a plurality of contacts secured therein, the connector housing defining first and second endwalls, said first endwall having key structure;

a first shroud member secured to said connector housing proximate said first endwall, said first shroud member having means cooperable with said connector housing for securing said first shroud member to said connector housing, said first shroud member having keying means complementary to the key structure on the connector housing coacting with said key structure and an extension section, said extension section adapted to extend beyond said first endwall, said extension section having guide means tapered inwardly toward the connector housing for guiding a complementary connector into the connector housing; and a second shroud member secured to said connector housing proximate said second endwall, whereby the key structure and the keying means provide a keying system to key the first shroud member to the first endwall of the connector housing.

13. An electrical connector assembly as recited in claim 12, further comprising a protrusion extending from the body section of said first shroud member, said protrusion adapted to extend beyond a bottom surface of the connector housing to be received in an aperture in a circuit board on which the connector assembly is mounted.

14. An electrical connector assembly as recited in claim 12, wherein the extension section further comprises an alignment surface between said guide means and the connector housing.

15. An electrical connector assembly as recited in claim 12, wherein the keying means has a trapezoidal cross section in a plane parallel to the bottom surface of the connector housing.

16. An electrical connector assembly as recited in claim 15, wherein the key structure has a trapezoidal cross section in a plane parallel to the bottom surface of the connector housing.

* * * * *